US010487837B2

(12) United States Patent
Tracz et al.

(10) Patent No.: US 10,487,837 B2
(45) Date of Patent: Nov. 26, 2019

(54) MULTI-STAGE IMPELLER ASSEMBLY FOR PUMP

(71) Applicant: LITENS AUTOMOTIVE PARTNERSHIP, Woodbridge (CA)

(72) Inventors: Roman Tracz, Mississauga (CA); Jacek Stepniak, Innisfil (CA); Ivan Ferlik, Richmond Hill (CA); Leonid Katsman, Richmond Hill (CA)

(73) Assignee: Litens Automotive Partnership, Woodbridge (CA)

( * ) Notice: Subject to any disclaimer, the term of this patent is extended or adjusted under 35 U.S.C. 154(b) by 210 days.

(21) Appl. No.: 15/545,183

(22) PCT Filed: Jan. 22, 2016

(86) PCT No.: PCT/CA2016/050057

§ 371 (c)(1),
(2) Date: Jul. 20, 2017

(87) PCT Pub. No.: WO2016/115641

PCT Pub. Date: Jul. 28, 2016

(65) Prior Publication Data

US 2018/0003182 A1 Jan. 4, 2018

Related U.S. Application Data

(60) Provisional application No. 62/106,699, filed on Jan. 22, 2015.

(51) Int. Cl.
*F04D 15/00* (2006.01)
*F04D 29/20* (2006.01)
(Continued)

(52) U.S. Cl.
CPC ..... *F04D 15/0027* (2013.01); *F01P 5/12* (2013.01); *F04D 29/20* (2013.01); *F04D 29/2261* (2013.01); *F04D 29/247* (2013.01)

(58) Field of Classification Search
CPC .. F04D 15/0027; F04D 29/20; F04D 29/2261; F04D 29/247; F01P 5/12; F01P 7/087; F01P 7/08
See application file for complete search history.

(56) References Cited

U.S. PATENT DOCUMENTS 2,845,869 A * 8/1958 Herbenar ..... F04D 15/0061 415/12
3,228,380 A 1/1966 Stefan
(Continued)

FOREIGN PATENT DOCUMENTS

JP S62153596 A 7/1987

OTHER PUBLICATIONS

ISRandWO for PCT/CA2016/050057 dated Apr. 20, 2016.
JPS62153596—translated English abstract.

*Primary Examiner* — Thomas N Moulis
(74) *Attorney, Agent, or Firm* — Millman IP Inc.

(57) ABSTRACT

In an aspect, there is provided a pump impeller assembly that includes a first impeller portion arranged to drive a fluid through a fluid conduit, a second impeller portion movable between a more-rotationally engaged position in which the second impeller portion has a first amount of rotational engagement with the first impeller portion, and a less-rotationally engaged position in which the second impeller portion has a second amount of rotational engagement with the first impeller portion that is less than the first amount of rotational engagement, and an actuator operatively connected to the second impeller portion and configured to drive movement of the second impeller portion between the more-rotationally engaged position and the less-rotationally engaged position based on a fluid property.

3 Claims, 17 Drawing Sheets

(51) Int. Cl.

| | |
|---|---|
| ***F04D 29/22*** | (2006.01) |
| ***F04D 29/24*** | (2006.01) |
| ***F01P 5/12*** | (2006.01) |

(56) References Cited

U.S. PATENT DOCUMENTS 3,918,831 A 11/1975 Grennan
4,417,849 A 11/1983 Morris
6,638,031 B1 * 10/2003 Humburg ..... B60H 1/00485 237/12.3 B
6,725,812 B1 * 4/2004 Scott ..... F01P 5/12 123/41.44
6,725,813 B1 * 4/2004 Boyer ..... F01P 5/10 123/41.44
7,032,546 B2 * 4/2006 Kaya ..... F01P 5/12 123/41.44
7,475,764 B2 * 1/2009 Schultheiss ..... F01P 5/12 192/103 R
7,914,264 B2 * 3/2011 Baumgartner ..... F01P 5/12 192/58.61
9,028,228 B2 * 5/2015 Shepherd ..... F04D 13/027 417/218
9,133,893 B2 * 9/2015 Tilly ..... F01P 5/043
9,523,393 B2 * 12/2016 Roby ..... F16D 27/11
2002/0012593 A1 * 1/2002 Okuda ..... F01P 5/12 417/362
2002/0083905 A1 * 7/2002 Kim ..... B60H 1/00314 123/41.01
2004/0238316 A1 * 12/2004 Gotschhofer ..... F16D 43/25 192/107 M
2005/0188927 A1 * 9/2005 Kaya ..... F01P 5/12 123/41.44
2009/0097996 A1 * 4/2009 Sakumoto ..... F04D 15/00 417/420
2010/0163215 A1 * 7/2010 Li ..... F04D 1/06 165/120
2011/0052425 A1 * 3/2011 Yoon ..... F04D 13/024 417/223
2011/0255970 A1 * 10/2011 Fei ..... F04D 15/0038 416/44
2012/0204818 A1 * 8/2012 Welte ..... F04D 15/0038 123/41.08
2013/0313068 A1 11/2013 Mevissen et al.
2016/0084145 A1 * 3/2016 Fulton ..... F04D 15/0022 415/118
2016/0273543 A1 * 9/2016 Blad ..... F04D 1/00

* cited by examiner

MULTI-STAGE IMPELLER ASSEMBLY FOR PUMP

CROSS-REFERENCE TO RELATED APPLICATIONS

This application claims priority to U.S. Provisional Patent Application No. 62/106,699 filed Jan. 22, 2015, the contents of which are incorporated herein in their entirety.

FIELD

This disclosure relates to fluid pumps and more particularly to water pumps for stationary or vehicular engines wherein the water pump is driven in direct proportion to the speed of the engine.

BACKGROUND

It is known to provide water pumps on stationary or vehicular engines in order to circulate coolant through the engine in order to prevent the engine from overheating. In many applications, the water pump is driven by a belt or the like that is itself driven by a crankshaft of the engine. As a result, the speed of the water pump is determined by the speed of the engine. The coolant flow of the water pump is generally selected so that in the worst case combination of engine speed and cooling needs, the engine will be sufficiently cooled by the coolant flow from the water pump. However, inherent in such a design practice is that that water pump is pumping more coolant than necessary in some situations.

It would be advantageous to be able to provide a water pump or a pump in general that had some means of reducing coolant flow when it is not needed.

SUMMARY

In an aspect, there is provided a pump impeller assembly. The assembly includes a first impeller portion that is arranged to drive a fluid through a fluid conduit, a second impeller portion that is movable between a more-rotationally engaged position in which the second impeller portion has a first amount of rotational engagement with the first impeller portion, and a less-rotationally engaged position in which the second impeller portion has a second amount of rotational engagement with the first impeller portion that is less than the first amount of rotational engagement, and an actuator that is operatively connected to the second impeller portion and is configured to drive movement of the second impeller portion between the more-rotationally engaged position and the less-rotationally engaged position based on a fluid property. The fluid property may, for example, be a pressure of the fluid. Alternatively, the fluid property may, for example, be a temperature of the fluid. Alternatively, the fluid property may be any suitable fluid property.

In another aspect, there is provided a pump impeller assembly. The assembly includes a first impeller portion that is arranged to drive a fluid through a fluid conduit, a second impeller portion that is movable between a more-rotationally engaged position in which the second impeller portion has a first amount of rotational engagement with the first impeller portion, and a less-rotationally engaged position in which the second impeller portion has a second amount of rotational engagement with the first impeller portion that is less than the first amount of rotational engagement, and an actuator that is operatively connected to the second impeller portion and that is responsive to a fluid property for movement from a first actuator position to a second actuator position during which the actuator causes the second impeller portion to move from one of the more- and less-rotationally engaged positions to the other of the more- and less-rotationally engaged positions. The fluid property may, for example, be a pressure of the fluid. Alternatively, the fluid property may, for example, be a temperature of the fluid. Alternatively, the fluid property may be any suitable fluid property.

In another aspect, there is provided a pump including a pump housing, an input shaft rotatably supported by the pump housing and a pump impeller assembly supported on the input shaft. The impeller assembly includes a first impeller portion that is rotationally connected to the input shaft so as to be driven thereby so as to drive a fluid through a fluid conduit, a second impeller portion that is movable between a more-rotationally engaged position in which the second impeller portion has a first amount of rotational engagement with the first impeller portion, and a less-rotationally engaged position in which the second impeller portion has a second amount of rotational engagement with the first impeller portion that is less than the first amount of rotational engagement, and an actuator that is operatively connected to the second impeller portion and is configured to drive movement of the second impeller portion between the more-rotationally engaged position and the less-rotationally engaged position based on a fluid property. The fluid property may, for example, be a pressure of the fluid. Alternatively, the fluid property may, for example, be a temperature of the fluid. Alternatively, the fluid property may be any suitable fluid property.

In yet another aspect, there is provided a pump impeller assembly. The assembly includes a first impeller portion that is arranged to drive a fluid through a fluid conduit, a second impeller portion that is movable between a more-rotationally engaged position in which the second impeller portion has a first amount of rotational engagement with the first impeller portion, and a less-rotationally engaged position in which the second impeller portion has a second amount of rotational engagement with the first impeller portion that is less than the first amount of rotational engagement, and an actuator that is operatively connected to the second impeller portion and is configured to drive movement of the second impeller portion between the more-rotationally engaged position and the less-rotationally engaged position.

In yet another aspect, there is provided a pump impeller assembly. The assembly includes a first impeller portion that is arranged to drive a fluid through a fluid conduit, a second impeller portion that is movable between a more-rotationally engaged position in which the second impeller portion has a first amount of rotational engagement with the first impeller portion, and a less-rotationally engaged position in which the second impeller portion has a second amount of rotational engagement with the first impeller portion that is less than the first amount of rotational engagement, and an actuator that is operatively connected to the second impeller portion and is movable from a first actuator position to a second actuator position during which the actuator causes the second impeller portion to move from one of the more- and less-rotationally engaged positions to the other of the more- and less-rotationally engaged positions.

BRIEF DESCRIPTION OF THE DRAWINGS

The foregoing and other aspects will now be described by way of example only with reference to the attached drawings, in which.

DETAILED DESCRIPTION OF EXAMPLE EMBODIMENTS

Impeller Assembly Engagement Controlled by Pressure

Figure 1:
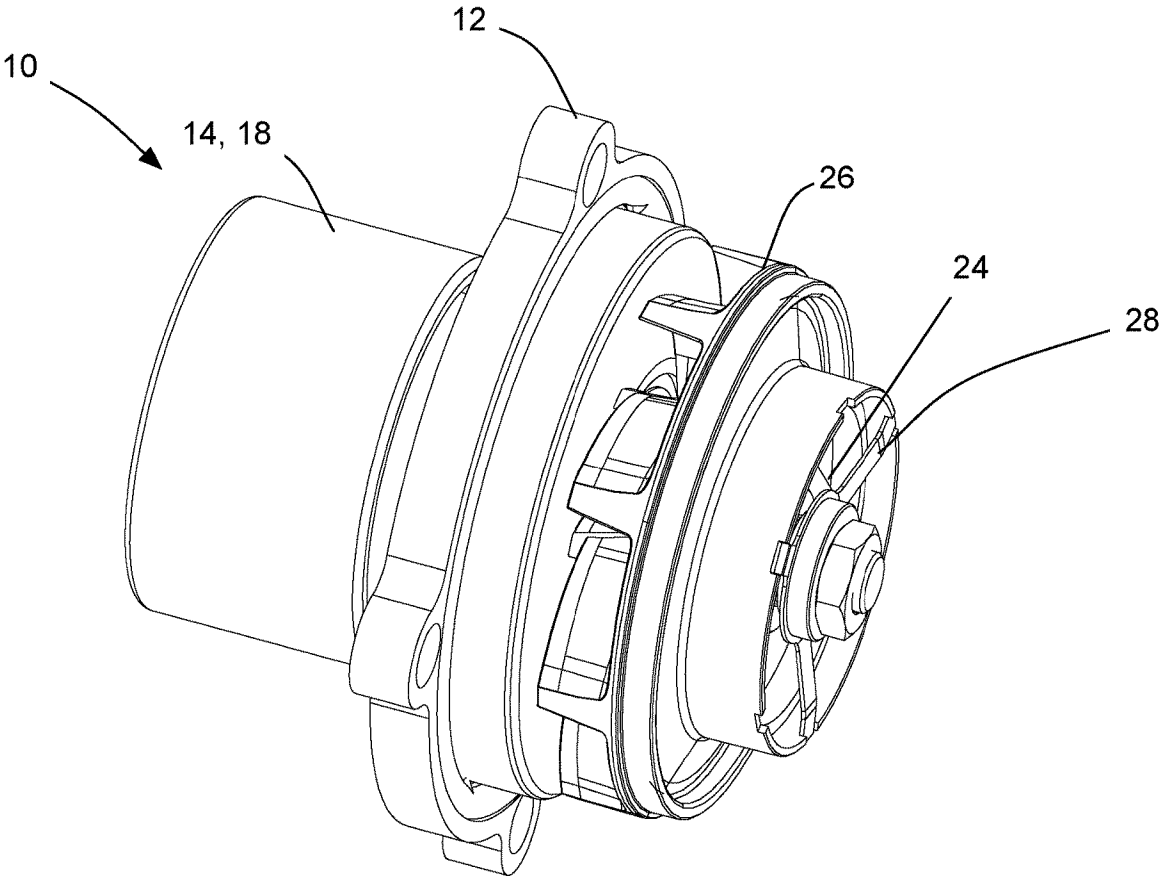
FIG. 1 is a perspective view of a pump for pumping a fluid according to an example embodiment of the present disclosure.
Figure 2:
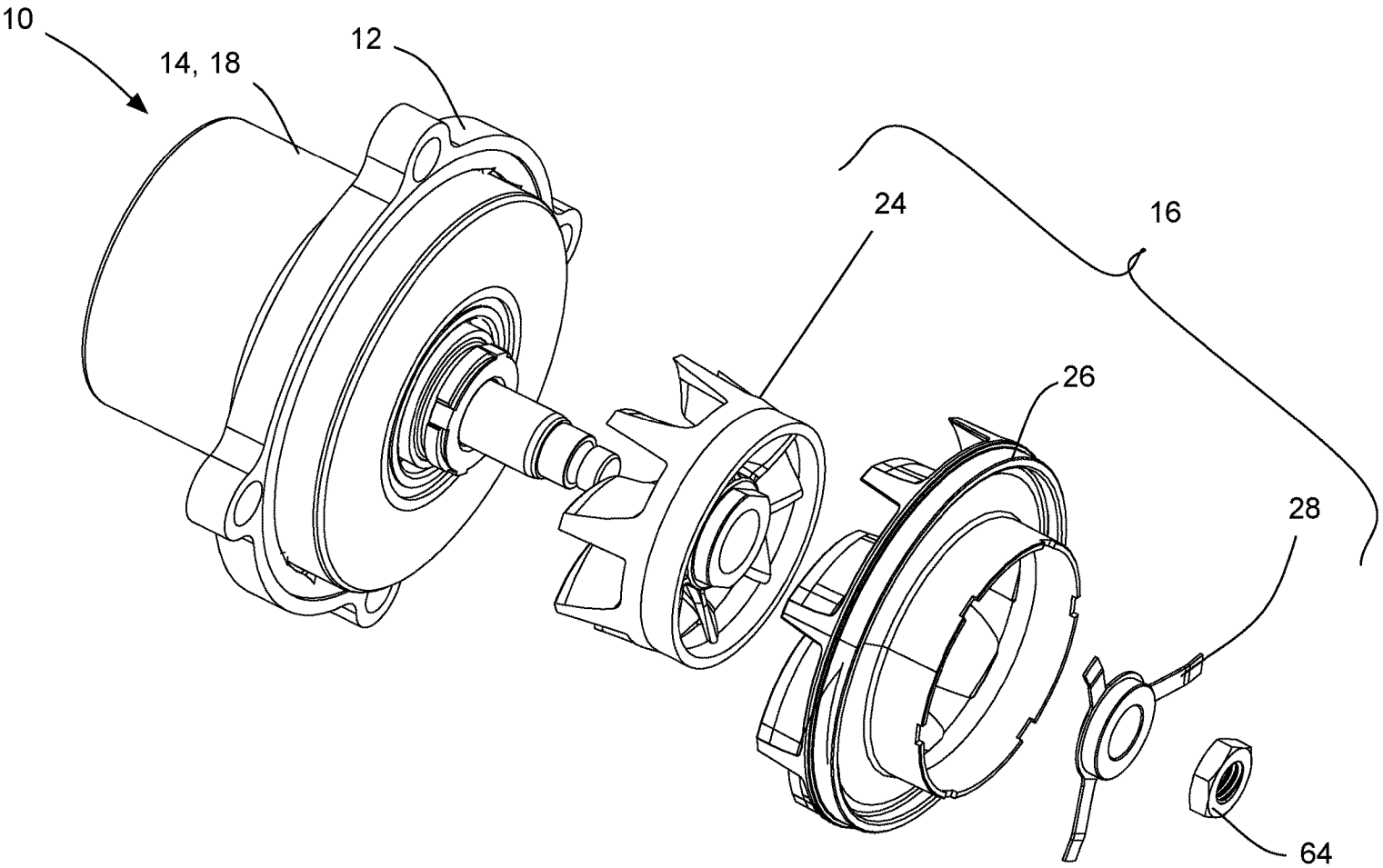
FIG. 2 is a perspective exploded view of the pump shown in FIG. 1.
Figure 3:
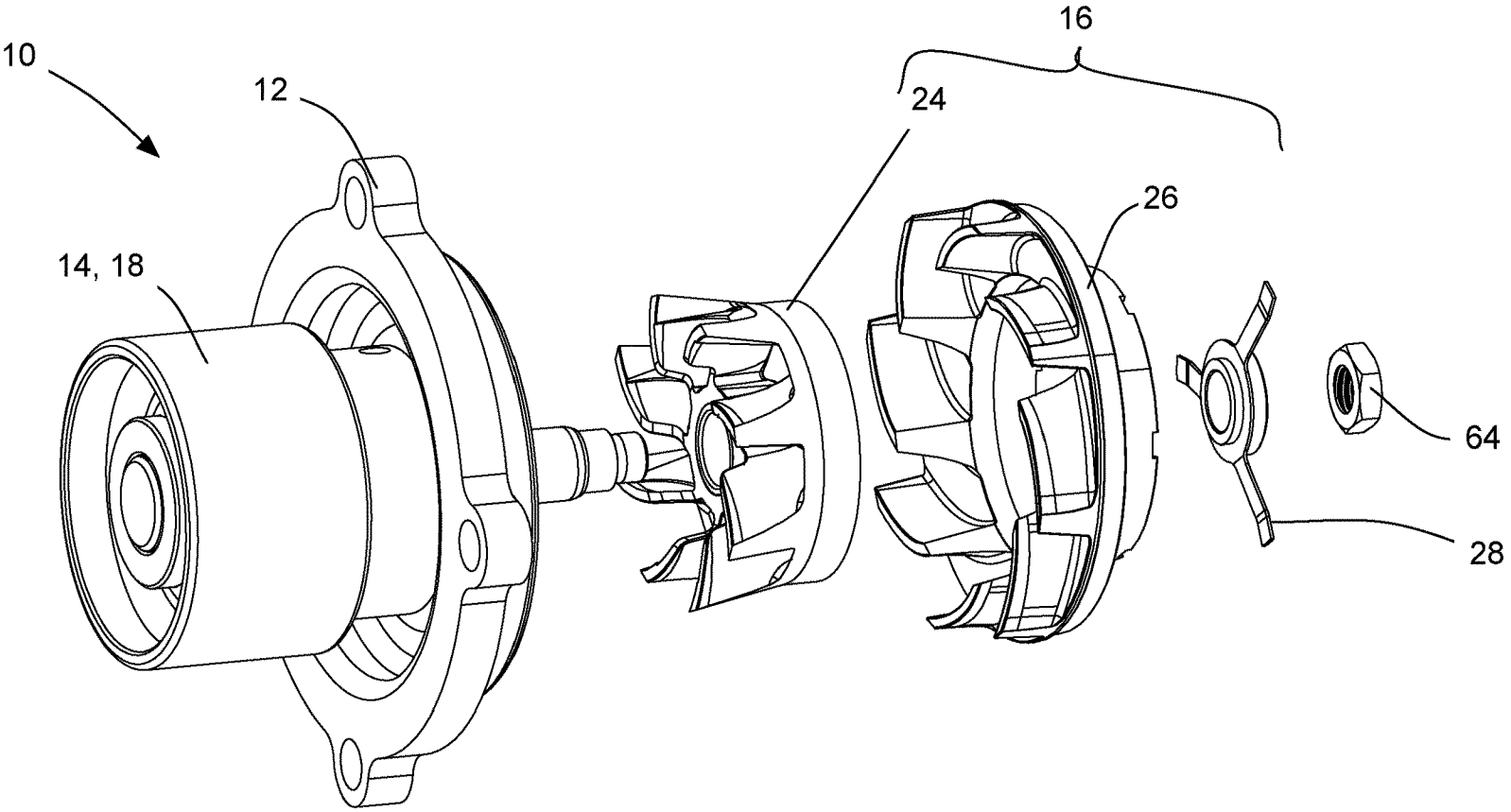
FIG. 3 is another perspective exploded view of the pump shown in FIG. 1.

Reference is made to FIG. 1, which shows an example pump 10 for pumping a fluid through a flow conduit system. For example, the pump 10 may be a water pump that is driven by the engine (shown at 11 in FIGS. 4 and 5) of a vehicle (e.g. via a front-engine accessory drive belt, a timing belt or chain, a gear train or some other power transmission means).

The pump 10 includes a pump housing 12 that may be fixedly connected to the block of the engine 11, a power input device 14, and an impeller assembly 16. Referring to FIGS. 2-5. The power input device 14 is operatively connected to an input shaft 20. In the examples shown in Figures the power input device 14 is a pulley 18 that is fixedly mounted to an input shaft 20. The pulley 18 can receive rotary power from the aforementioned front-engine accessory drive belt (not shown) so as to drive the input shaft 20. Any other suitable power input device may instead be provided.

The input shaft 20 is rotatably supported in the housing 12 by means of a bearing 22. The input shaft 20 and bearing 22 may be provided together as an integral shaft bearing.

Figure 4:
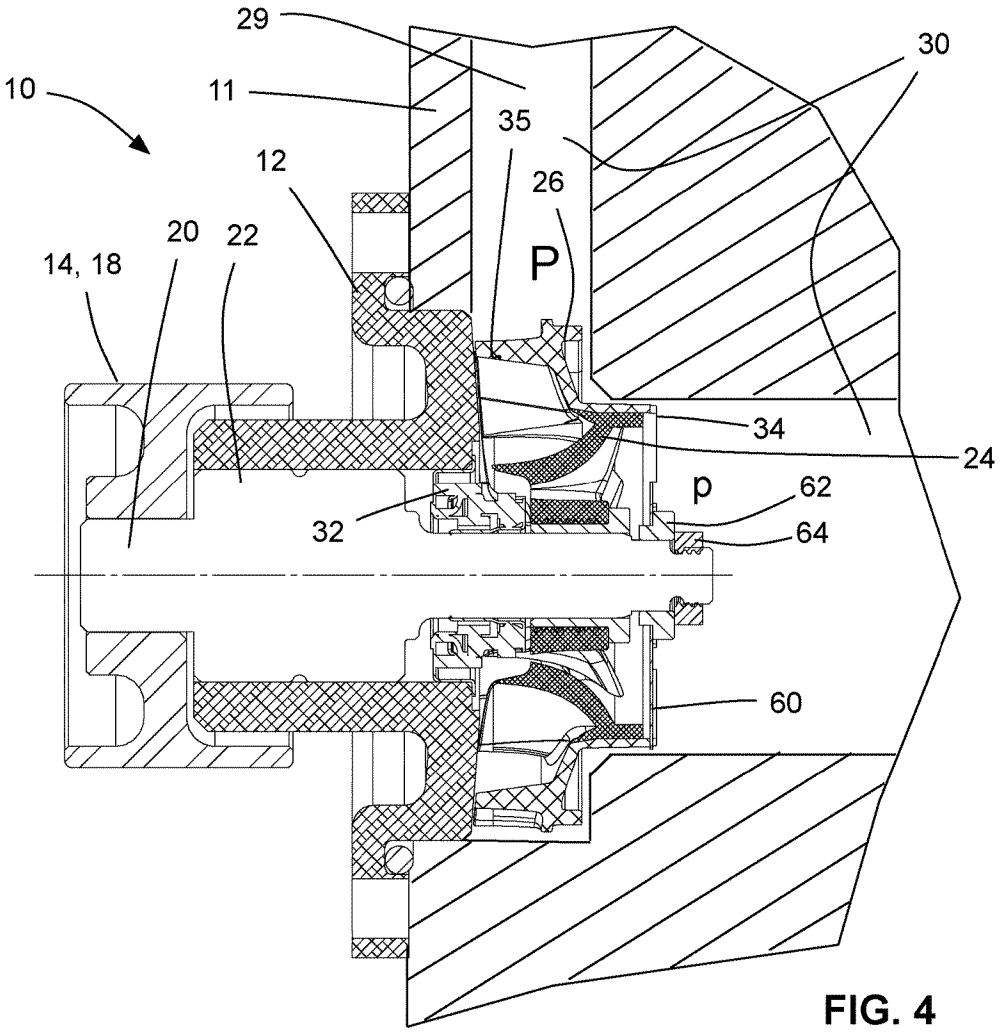
FIG. 4 is a sectional side view of the pump shown in FIG. 1 showing a first impeller portion and a second impeller portion, wherein the second impeller portion is in a more-rotationally engaged position with the first impeller portion.
Figure 5A:
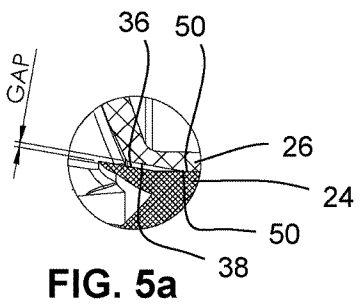
FIG. 5*a* is a magnified sectional side view of a portion of the view shown in FIG. 5.
Figure 5:
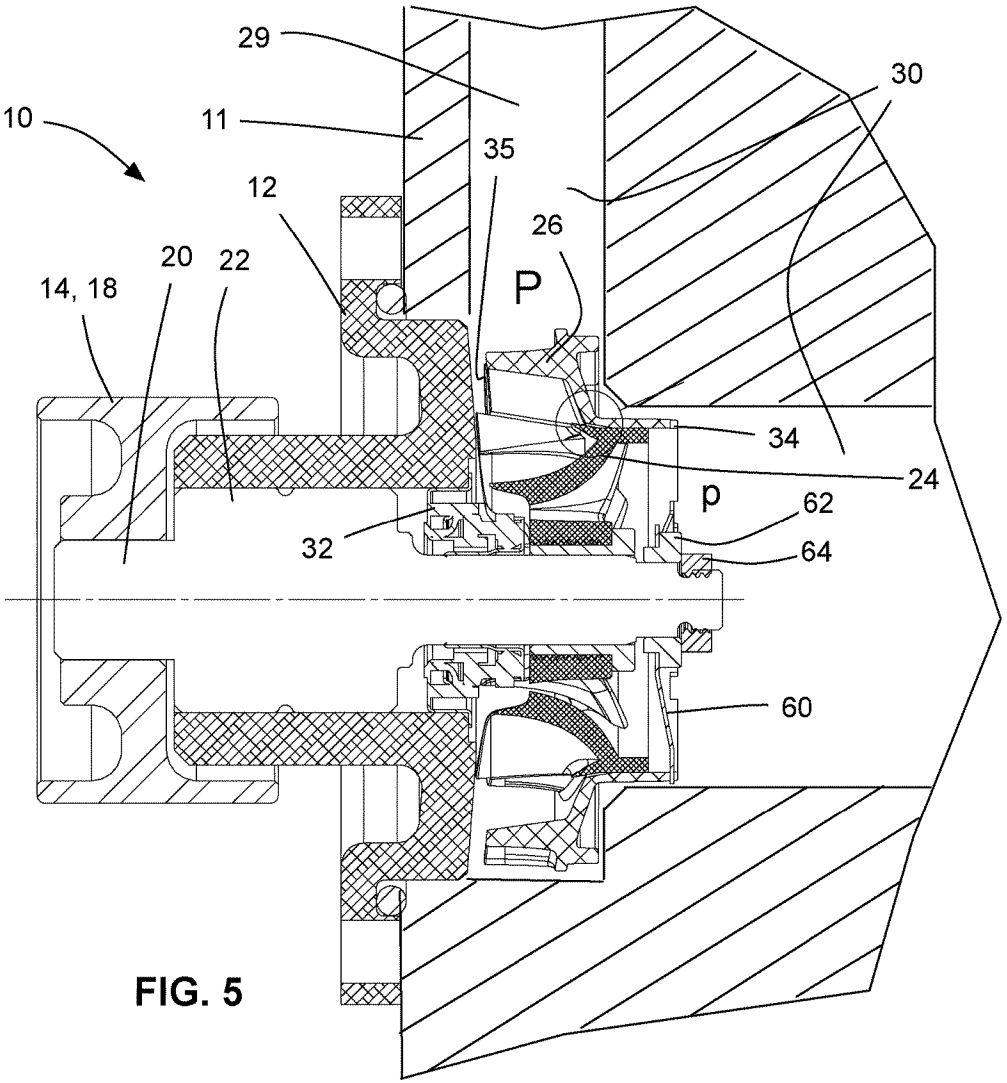
FIG. 5 is a sectional side view of the pump shown in FIG. 4 wherein the second impeller portion is in a less-rotationally engaged position with the first impeller portion.
Figure 6:
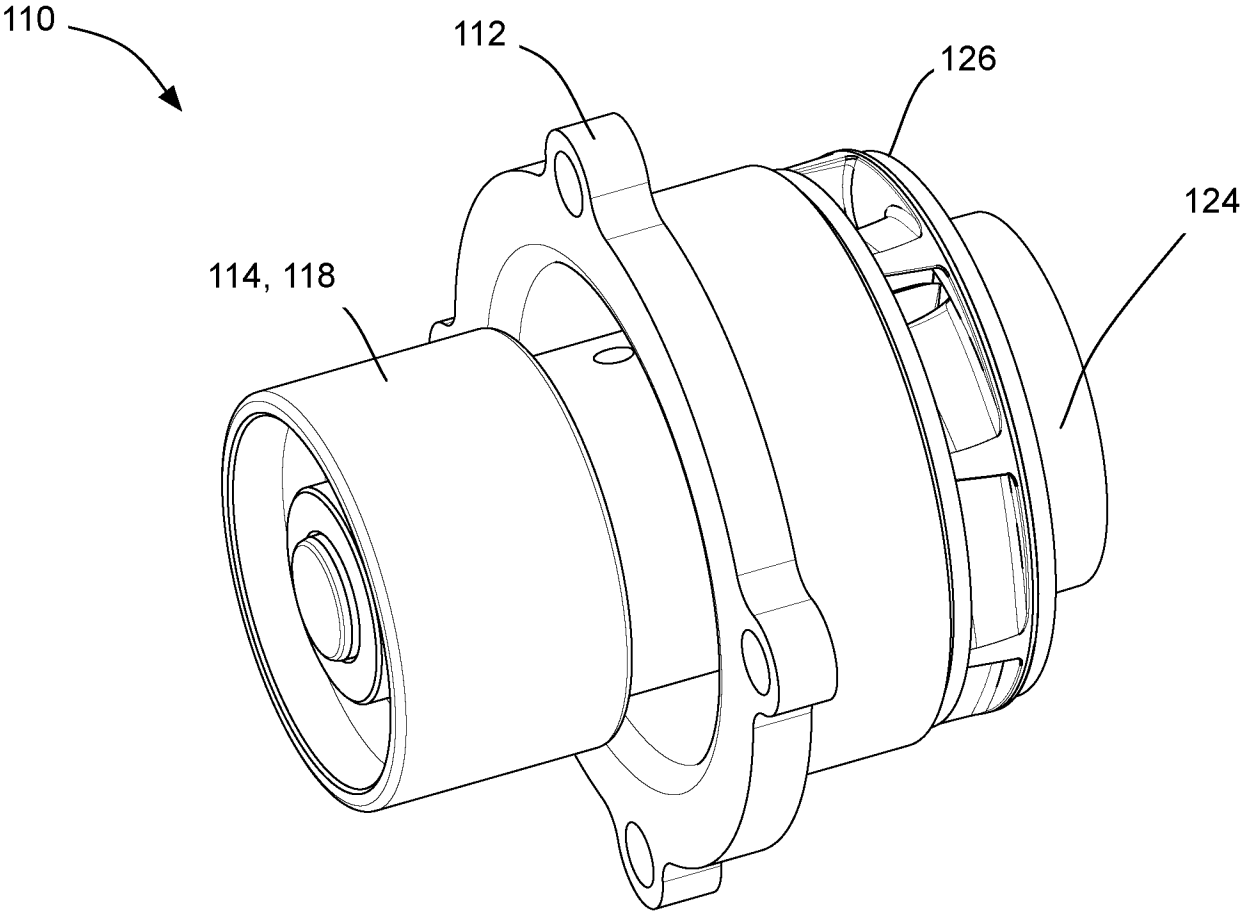
FIG. 6 is a perspective view of a pump for pumping a fluid according to another example embodiment of the present disclosure.
Figure 7:
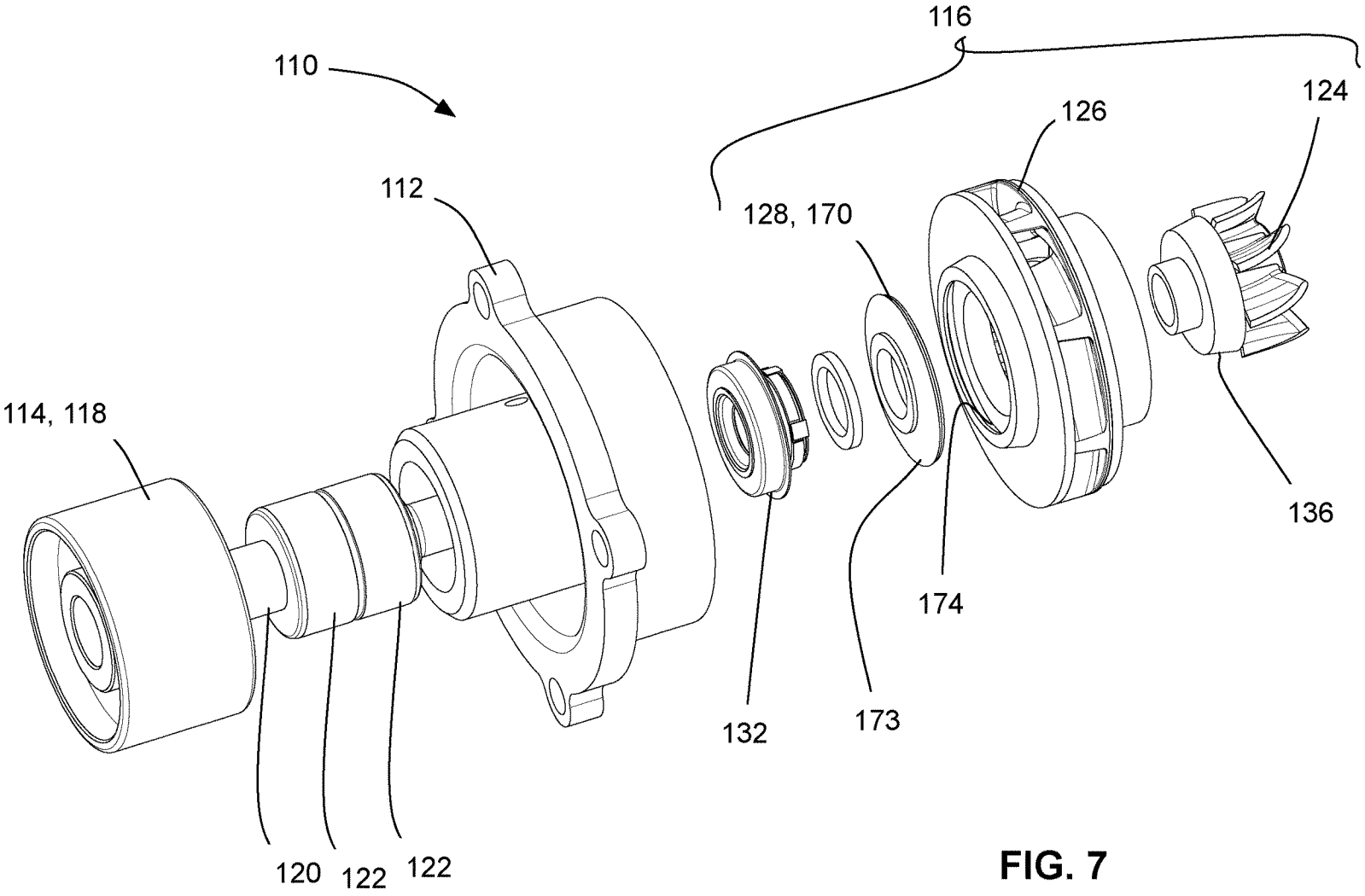
FIG. 7 is a perspective exploded view of the pump shown in FIG. 6.
Figure 8:
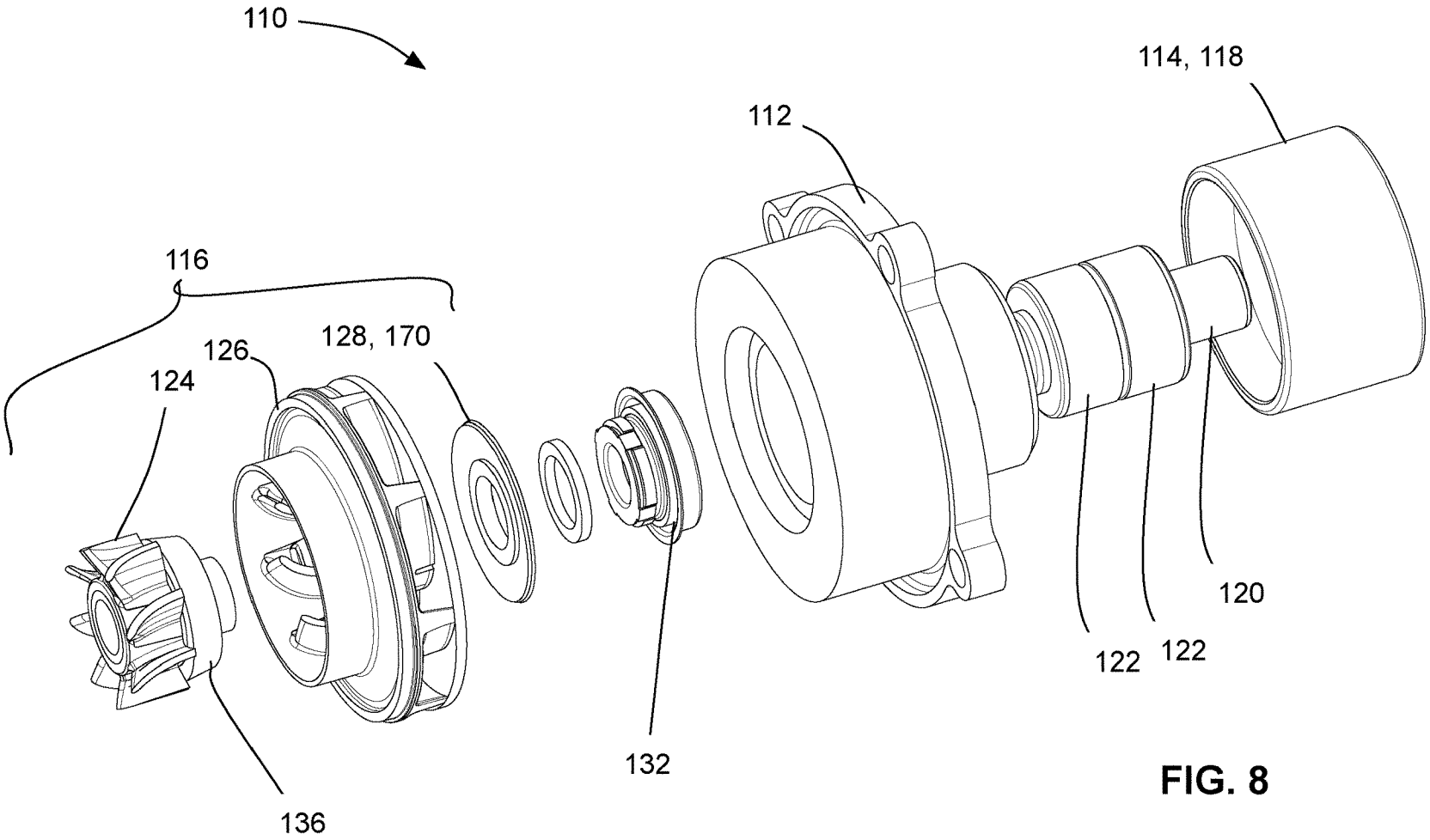
FIG. 8 is another perspective exploded view of the pump shown in FIG. 6.
Figure 9:
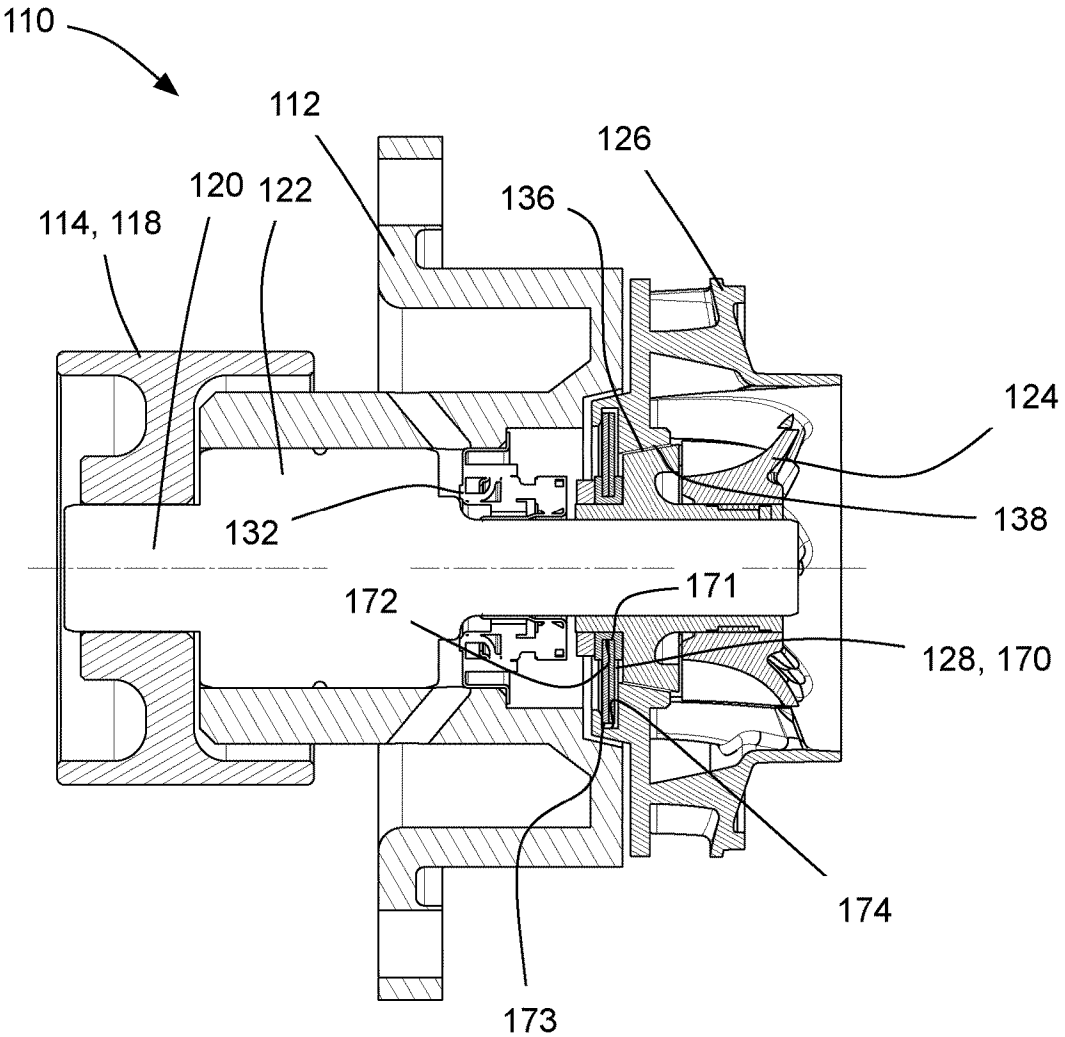
FIG. 9 is a sectional side view of the pump shown in FIG. 6 showing a first impeller portion and a second impeller portion, wherein the second impeller portion is in a more-rotationally engaged position with the first impeller portion.
Figure 10:
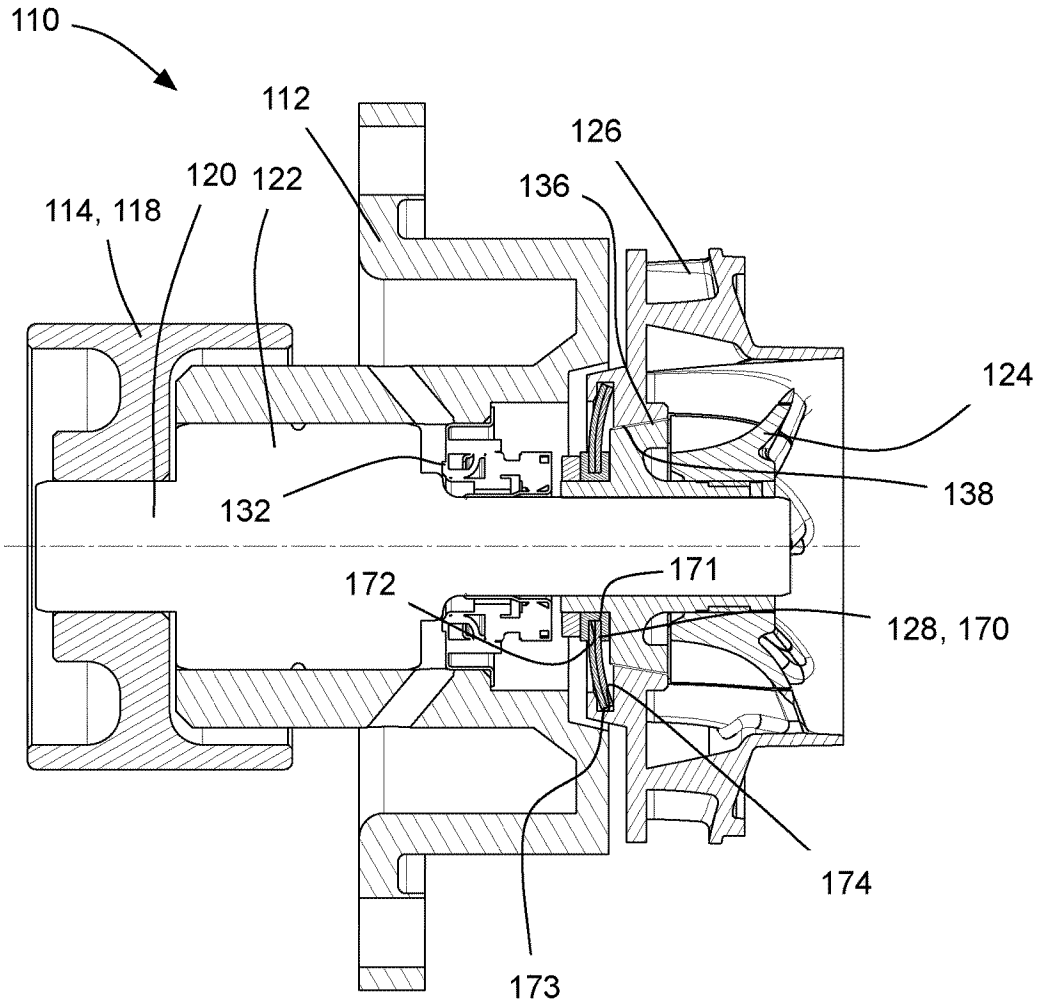
FIG. 10 is a sectional side view of the pump shown in FIG. 9 wherein the second impeller portion is in a less-rotationally engaged position with the first impeller portion.
Figure 11:
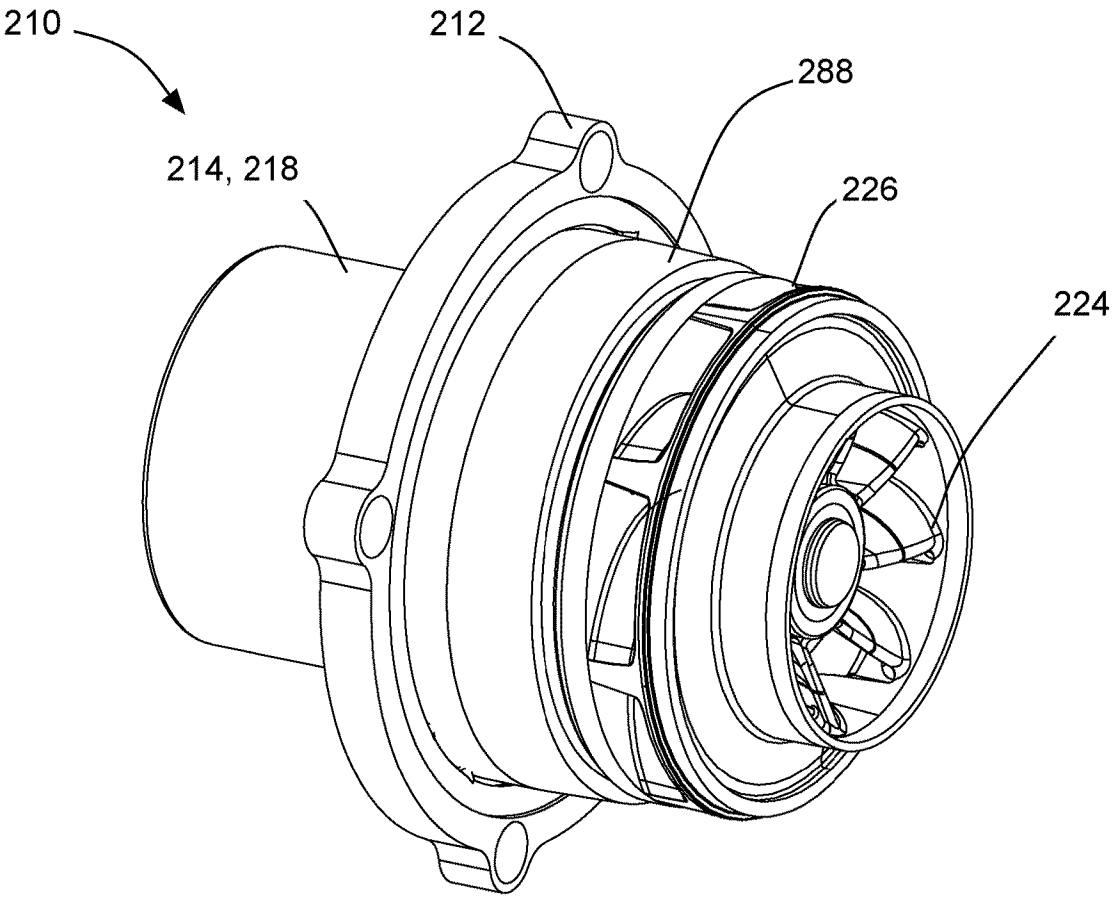
FIG. 11 is a perspective view of a pump for pumping a fluid according to yet another example embodiment of the present disclosure.
Figure 12:
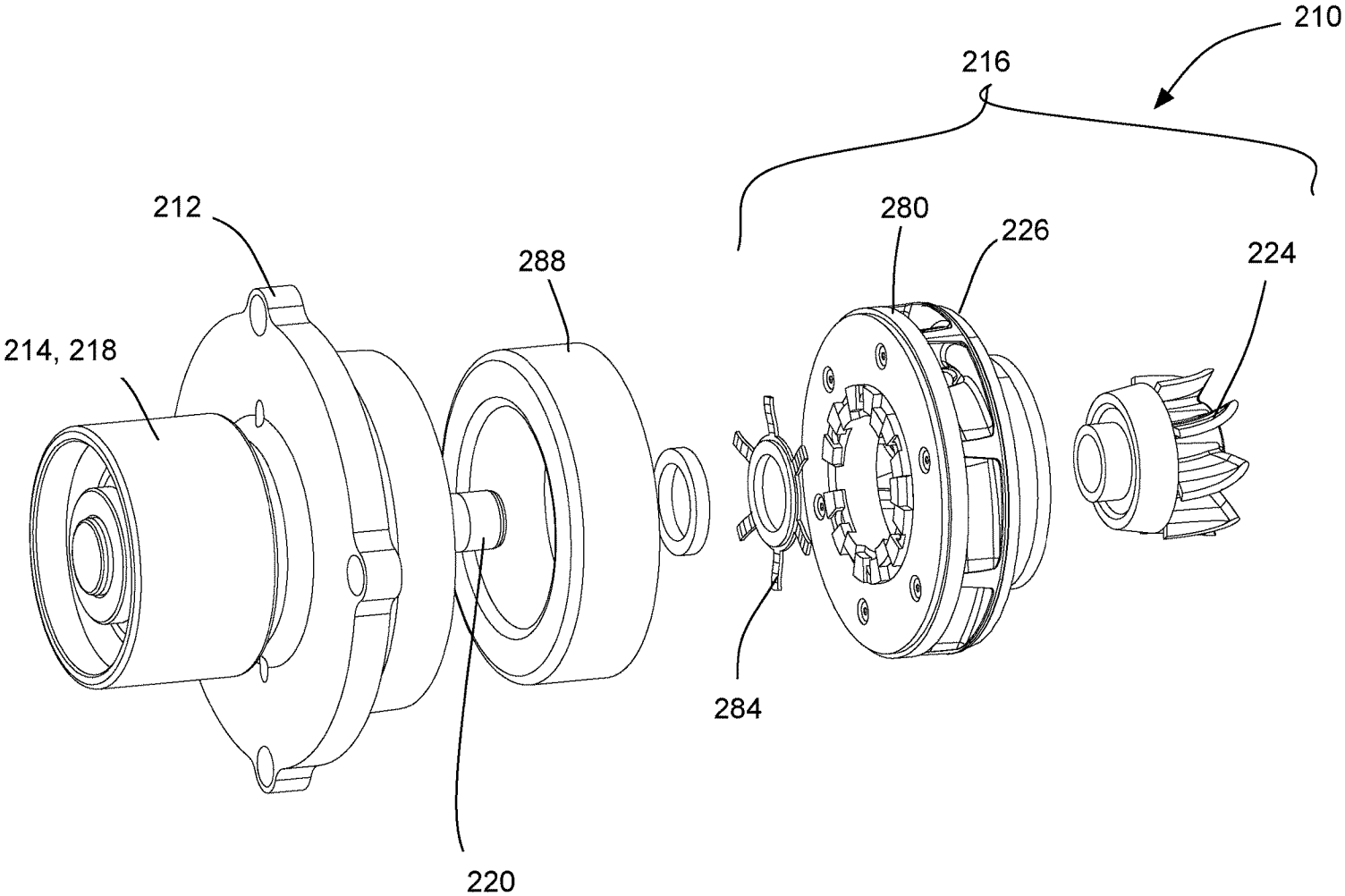
FIG. 12 is a perspective exploded view of the pump shown in FIG. 11.
Figure 13:
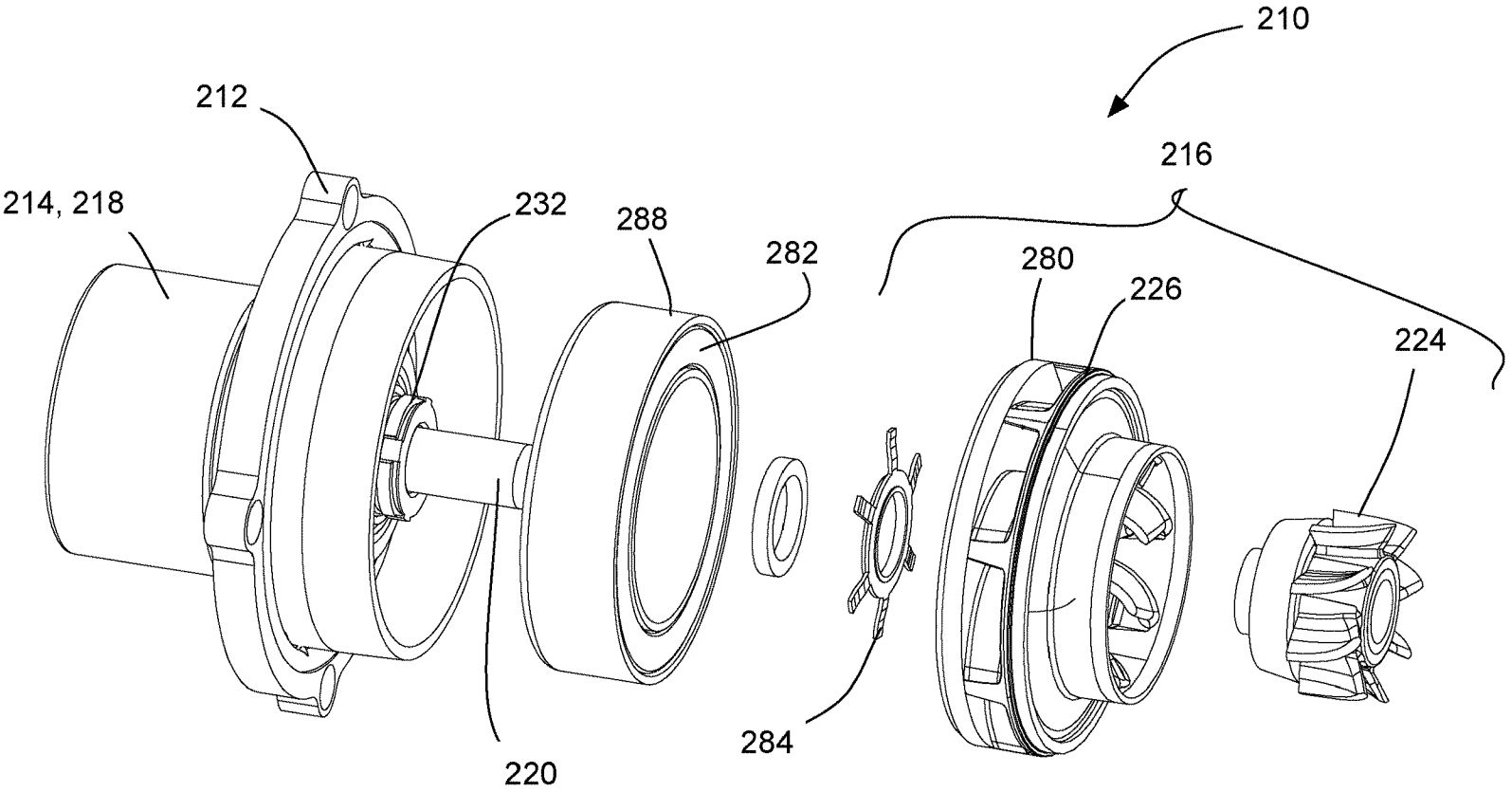
FIG. 13 is another perspective exploded view of the pump shown in FIG. 11.
Figure 14:
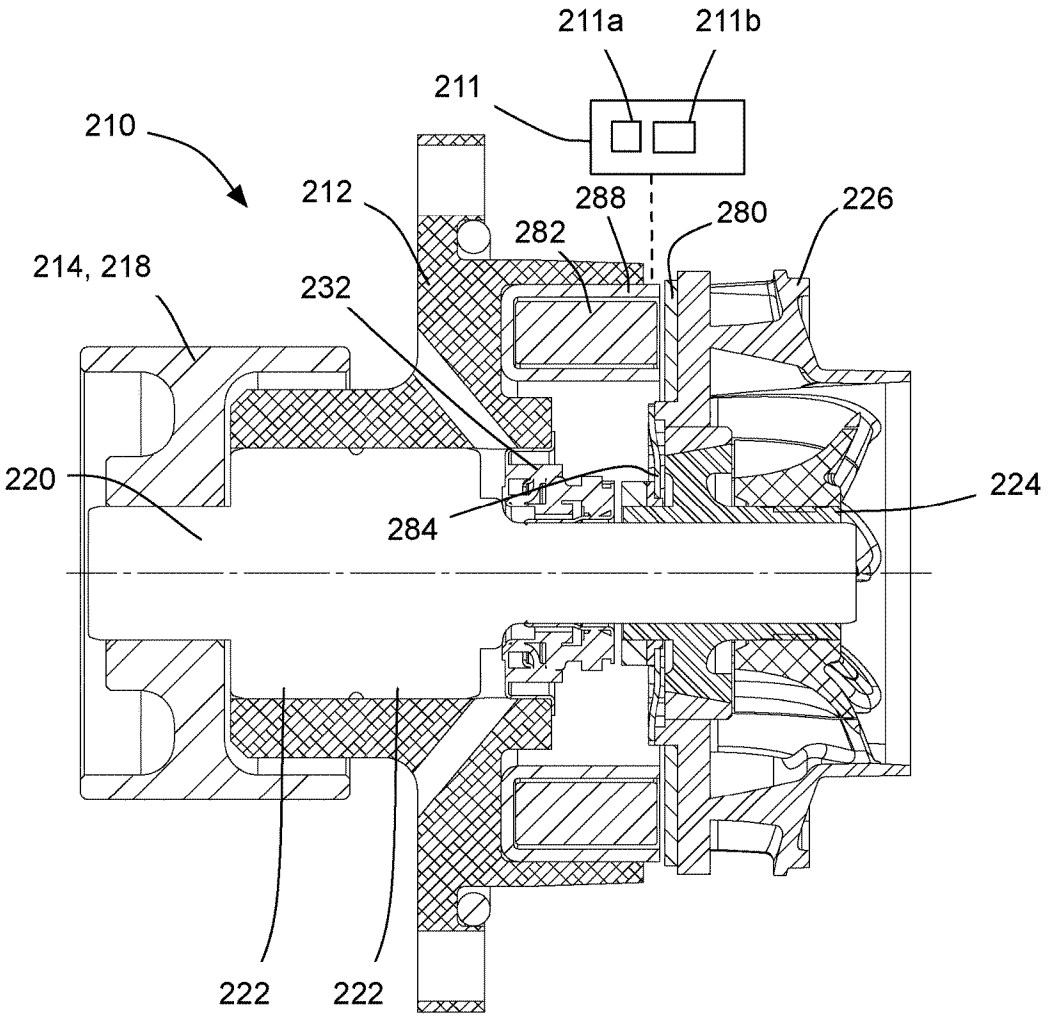
FIG. 14 is a sectional side view of the pump shown in FIG. 11 with a first impeller portion and a second impeller portion, wherein the second impeller portion is in a more-rotationally engaged position with the first impeller portion.
Figures 15, 15A:
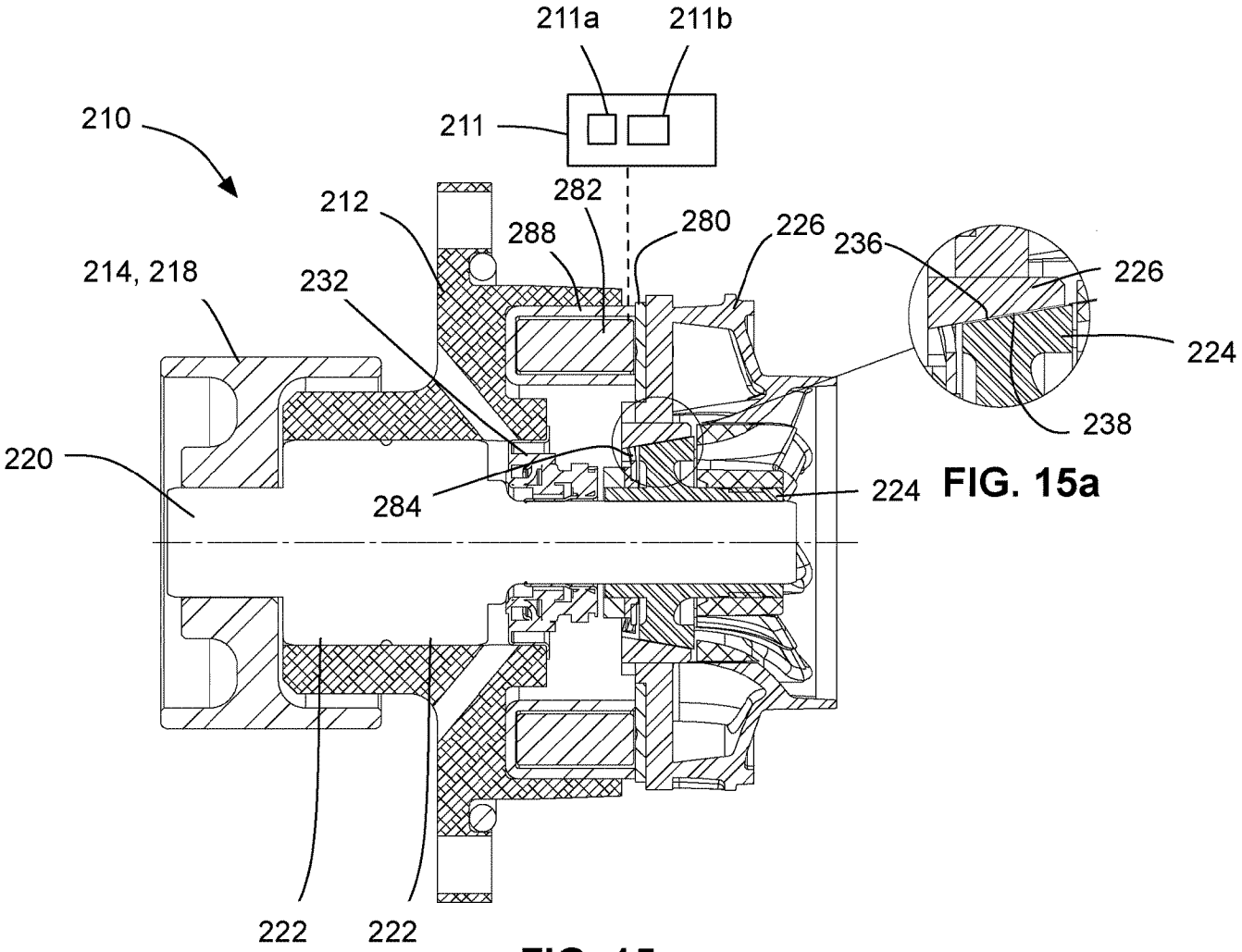
FIG. 15 is a sectional side view of the pump shown in FIG. 14 wherein the second impeller portion is in a less-rotationally engaged position with the first impeller portion.
FIG. 15*a* is a magnified sectional side view of a portion of the view shown in FIG. 15.

The impeller assembly 16 is supported on the input shaft 20. The impeller assembly 16 includes a first impeller portion 24, a second impeller portion 26 and an actuator 28 (which may also be referred to as an impeller actuator 28). The first impeller portion 24 is rotationally connected to the input shaft 20 (e.g. via a keyed connection, a splined connection, or any other suitable type of connection) so as to be driven thereby so as to drive a fluid 29 through a fluid conduit 30 (FIGS. 4 and 5). The first impeller portion 24 may thus be said to be arranged to drive the fluid 29 through the fluid conduit 30.

The second impeller portion 26 is movable between a more-rotationally engaged position (FIG. 4) in which the second impeller portion 26 has a first amount of rotational engagement with the first impeller portion 24, and a less-rotationally engaged position (FIG. 5) in which the second impeller portion 26 has a second amount of rotational engagement with the first impeller portion 24 that is less than the first amount of rotational engagement. In the more-rotationally engaged position, the second impeller portion 26 may be fully engaged with the first impeller portion 24 such that there is no relative rotation between the two impeller portions 24 and 26. In such embodiments, the more-rotationally engaged position may also be referred to as a fully rotationally engaged position.

In the less-rotationally engaged position (FIG. 5), there is relative rotation between the second impeller portion 26 and the first impeller 24. In the embodiments shown in the figures, when in the less-rotationally engaged position, the second impeller 26 may be substantially stationary while the first impeller portion 24 is driven to rotate by the shaft. In such embodiments the less-rotationally engaged position may alternatively be referred to as a disengaged position.

To move between the more-rotationally engaged position and the less-rotationally engaged position, the second impeller portion 26 may be slidably supported on the input shaft 20 without being rotationally connected on the input shaft 20.

A shaft seal 32 is shown between the impeller assembly 16 and the input shaft 20 to prevent leakage of fluid 29 therebetween.

The actuator 28 applies a force to the second impeller portion 26 to drive the second impeller portion 26 towards the fully rotationally engaged position in which the second impeller portion 26 is engaged with the first impeller portion 24 so as to be rotationally driven by the first impeller portion 24. The actuator 28 may include a spring 60, such as a tri-armed leaf spring, that is supported by a spring support bushing 62 on the input shaft 20. The spring 60 may bear on a spring retaining nut 64 fixedly mounted onto the input shaft 20. The actuator 28 may thus be said to be operatively connected to the second impeller portion 26 and is configured to drive movement of the second impeller portion 26 between the more-rotationally engaged position and the less-rotationally engaged position based on a fluid property. In the embodiment shown in FIGS. 1-5*a*, the fluid property is a pressure of the fluid. This is described more fully as follows. During operation of the pump 10, there is a pressure differential across the pump 10, such that a lower pressure zone (designated p) exists on the inlet side of the impeller assembly 16 (and more specifically, on a first side 34 of the second impeller portion 26, and a higher pressure zone (designated P) exists on the outlet or discharge side of the impeller assembly 16 (and more specifically, on a second side 35 of the second impeller portion 26), thereby providing a pressure differential between the first and second sides 34 and 35 of the second impeller portion 26.

Figure 16:
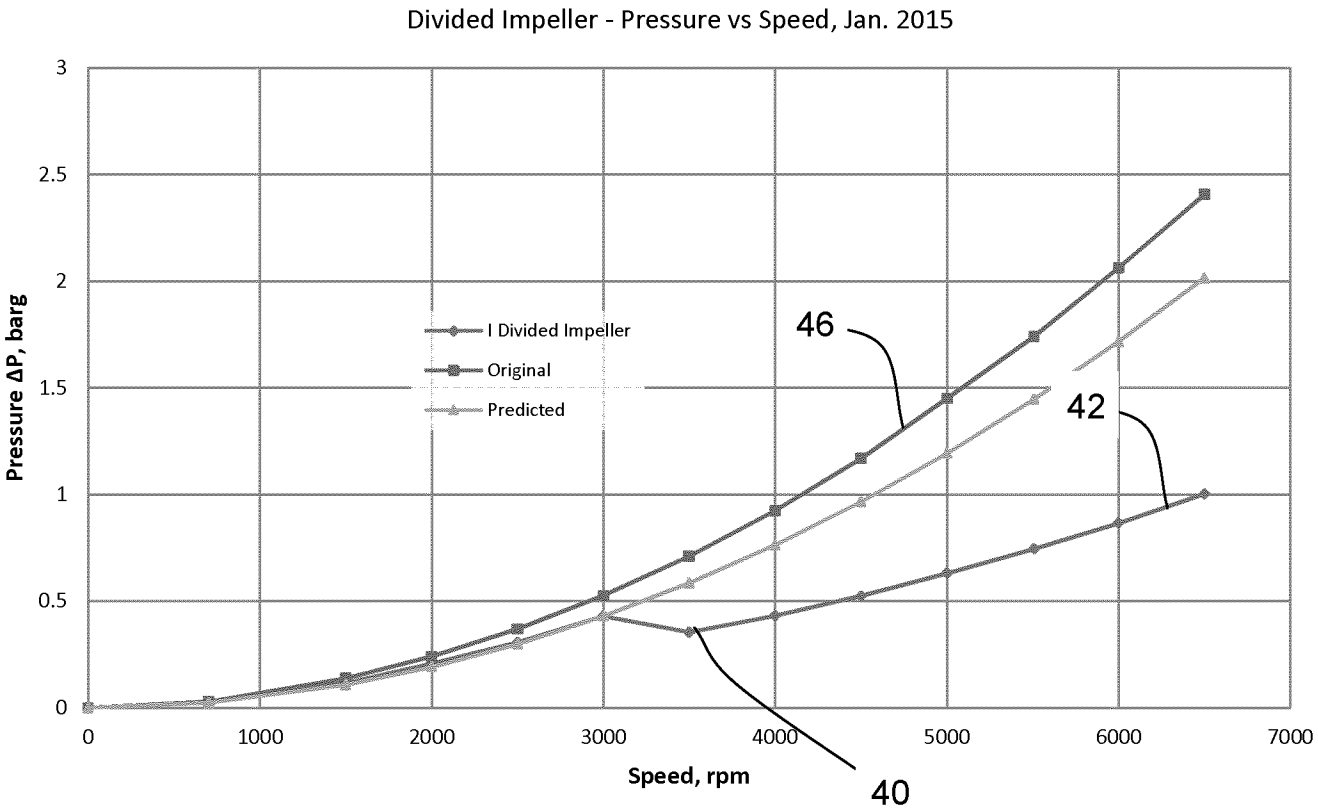
FIG. 16 is a graph illustrating the pressure differential across the pump shown in FIGS. 1-5*a*, as compared to a pump of the prior art.
Figure 17:
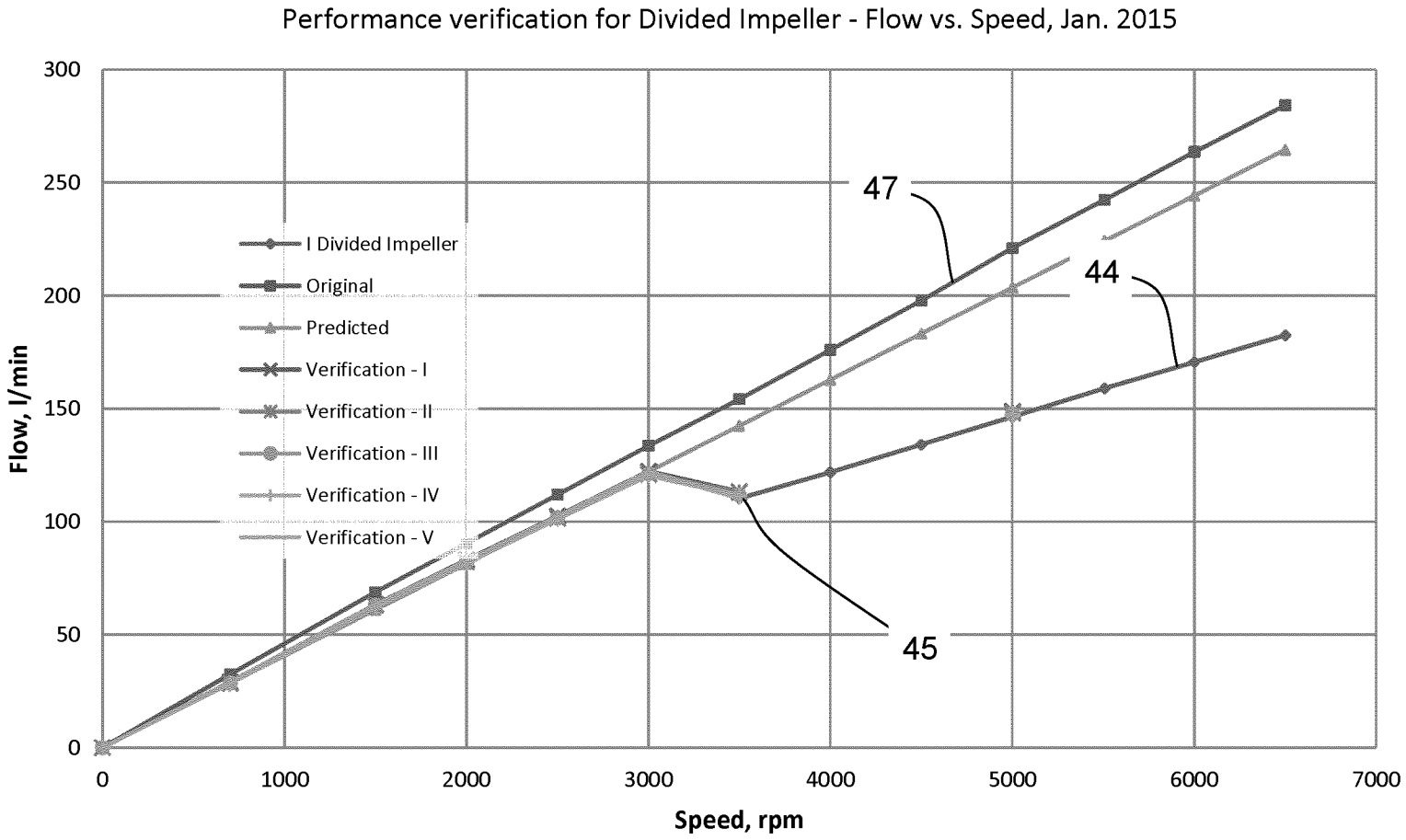
FIG. 17 is a graph illustrating the flow rate of the pump shown in FIGS. 1-5*a*, as compared to a pump of the prior art.

The engagement between the first and second impeller portions 24 and 26 when the second impeller portion 26 is in the more rotationally engaged position may be by any suitable means, such as by friction between their respective first and second mating drive surfaces shown at 36 and 38. In the embodiment shown in FIGS. 1-5*a*, if the pressure differential increases sufficiently, it will overcome the force applied by the actuator 28 and drive movement of the second impeller portion 26 towards the disengaged position. Once the second impeller portion 26 separates from the first impeller portion 24 (i.e. once the drive surfaces 36 and 38 separate from one another), the first impeller portion 24 no longer drives the second impeller portion 26. Thus, the second impeller portion 26 stops rotating, leaving only the first impeller portion 24 to drive flow through the pump 10. At this point, the pressure on the outlet side of the impeller assembly 16 (and the pressure differential across the impeller assembly 16) drops to a reduced level. This reduced level is shown in FIG. 16 at 40 on a pressure/RPM curve shown at 42 for the pump 10. FIG. 17 shows the volumetric flow rate/RPM curve 44 for the pump 10 and shows a corresponding reduced flow rate level at 45 that results when the second impeller portion 26 separates (i.e. disengages) from the first impeller portion 24.

Curves 46 and 47 show the pressure differential across and the flow rate for a pump that is structurally similar to the pump 10 but with a standard impeller of the prior art that is not separable. It will be noted, however, that the flow rate achieved by the pump of the prior art during high engine RPM is unnecessarily high. This is to ensure that the pump cools the engine 11 sufficiently at lower engine RPM's since the pump's RPM is directly proportional to the engine's RPM. Thus, at high RPM, the pump of the prior art overcools the engine 11 (i.e. cools the engine 11 more than necessary). As can be seen, by providing the impeller assembly 16, the highest flow rate and the highest pressure differential achieved by the pump 10 is lower than the corresponding values for the prior art pump. As a result of the lower pressure differential, one or more of several advantageous may be realized. For example, it may be possible to reduce the size and cost of some of the hoses, the radiator and the corresponding fittings that are part of the vehicle's cooling system, such that they are replaced with versions intended to handle lower pressures. This can reduce the cost of the cooling system, the weight of the cooling system and can increase the amount of room available underhood for other components.

Additionally, the amount of cooling imparted to the engine 11 is reduced, which can result in more efficient combustion and reduced emissions in some circumstances, since overcooling an engine 11 can reduce the temperatures in the combustion chambers to a point where incomplete combustion takes place if the overcooling is severe enough.

It will be understood that the second impeller portion 26 is not rotatably connected to the input shaft 20. In the embodiment shown in FIGS. 1-5*a*, the second impeller portion 26 is not even directly supported on the input shaft 20. Instead, the second impeller portion 26 is axially slidingly supported on the first impeller portion 24 by means of mating first and second support surfaces 48 and 50 on the first and second impeller portions 24 and 26 respectively.

In the embodiment shown in FIGS. 1-5*a*, some rotational force may be imparted to the second impeller portion 26 through frictional engagement at the support surfaces 48 and 50. The second impeller portion 26 may therefore rotate to some extent even when it is separated (i.e. disengaged) at the from the first impeller portion 24 at their respective first and second drive surfaces 36 and 38. This small amount of rotation of the second impeller portion 26 will contribute to a small extent to the flow through the pump 10 when the second impeller portion is in the less rotationally engaged position, but it will be understood that it would not contribute as much as when the drive surfaces 36 and 38 are engaged.

Impeller Assembly Engagement Controlled by Temperature

Reference is made to FIGS. 6-10 which show a pump 110 in accordance with another embodiment of the present disclosure. The pump 110 is similar to the pump 10 but has an impeller assembly that is actuated via an actuator that operates based on temperature instead of pressure (i.e. a different fluid property than that which controls the actuator 28 of the pump 10). Elements of the pump 110 with like functions or structure to elements of the pump 10 will be provided with like reference numbers but increased by 100. For example, the actuator for the pump 110 is identified at 128, whereas the actuator for the pump 10 is identified at 28.

The pump 110 includes a pump housing 112 which may be similar to the pump housing 12, a power input device 114 (e.g. a pulley 118), which may be similar to the power input device 14, and an impeller assembly 116, which may be similar to the impeller assembly 16, except that the impeller assembly 116 achieves disengagement of a first impeller portion 124 and a second impeller portion 126 based on temperature, as noted above, instead of pressure. More specifically, the impeller assembly 116 includes an actuator 128 that may be a temperature-responsive device, such as a bimetallic snap disk 170. The bimetallic snap disk 170 has a radially inner end 171 that is axially connected to the first impeller portion 124 (e.g. by being captured in a circumferential slot 172 of the first impeller portion 124). The bimetallic snap disk 170 has a radially outer end 173 that is axially connected to the second impeller portion 126 (e.g. by being captured in a circumferential slot 174 of the second impeller portion 126). The bimetallic snap disk 170 is not rotationally connected to at least one of the first and second impeller portions 124 and 126, thereby permitting the impeller portions 124 and 126 to rotate relative to one another when their drive surfaces 136 and 138 are disengaged from one another.

The bimetallic snap disc 170 is stable in a first position (FIG. 9) when its temperature is sufficiently high (e.g. is above a selected threshold temperature) and is stable in a second position (FIG. 10) when its temperature is sufficiently low (e.g. is below the selected threshold temperature). In the first position, the bimetallic snap disc 170 holds the first and second impeller portions 124 and 126 in engagement (i.e. such that their respective drive surfaces 136 and 138 are mated together, e.g. frictionally). In the second position, the bimetallic snap disc 170 holds the first and second impeller portions 124 and 126 in a disengaged position. In other words, the snap disc 170 may, in the first position, be said to hold the second impeller portion 126 in a more fully engaged position in which the second impeller portion 126 has a first amount of rotational engagement with the first impeller portion 124, and may, in the second position, be said to hold the second impeller portion 126 in a less fully engaged position in which the second impeller portion 126 has a second amount of rotational engagement with the first impeller portion 126 that is less than the first amount of rotational engagement.

By using the actuator 128, when the engine 11 is sufficiently hot, the higher flow rate achieved by the engaged first and second impeller portions 124 and 126 is used in order to cool the engine 11, and when the engine 11 is sufficiently cool, the lower flow rate is achieved by rotation substantially only by the first impeller portion 124 which is connected to the input shaft, shown at 120. The input shaft 120 is rotatably supported in the housing 112 by means of one or more bearings 122.

The actuator 128 may be used in embodiments in which it is desired for the engagement of the first and second impeller portions 124 and 126 to depend on temperature. Instead of a bimetallic snap disk 170, the actuator 128 could instead by some other temperature-dependent actuator, such as a wax actuator, a tri-metallic disk, a shape memory alloy actuator, or any other suitable type of actuator.

A shaft seal 132 is provided to prevent leakage of fluid between the input shaft 120 and the housing 112.

While it has been described that the operation of the actuator 128 is dependent on the temperature of the bimetallic snap disk, it will be understood that the temperature of the bimetallic snap disk is dependent on the temperature of the fluid. Thus, the operation of the actuator 128 is dependent on a fluid property, namely the temperature of the fluid.

The pumps 10 and 110 as described herein can separate the first and second impeller portions 24, 124 and 26, 126 without the need for a controller. Thus the operation of their respective actuators 28, 128 may be said to be passive.

In the embodiments shown in FIGS. 1-5*a* and 6-10, the actuator 28, 128 may be said to be operatively connected to the second impeller portion 26, 126 and is responsive to a fluid property (e.g. fluid pressure in the embodiment shown in FIGS. 1-5*a*, temperature in the embodiment shown in FIGS. 6-10) for movement from a first actuator position (FIGS. 4, 9) to a second actuator position (FIGS. 5, 10) during which the actuator causes the second impeller portion to move from one of the more- and less-rotationally engaged positions to the other of the more- and less-rotationally engaged positions.

Impeller Assembly Engagement Controlled by EM Coil and Controller

Reference is made to FIGS. 11-15*a*, which show a pump 210 in accordance with another embodiment of the present disclosure. Elements of the pump 210 with like functions or structure to elements of the pump 10 will be provided with like reference numbers but increased by 200. For example, the actuator for the pump 210 is identified at 228, whereas the actuator for the pump 10 is identified at 28.

The pump 210 is similar to the pump 10 but has an impeller assembly that is actuated via an actuator 228 that operates based on signals from a controller shown at 211. The controller 211 may itself receive signals from one or more sensors that detect one or more fluid properties, and may send signals to control the operation of the actuator 228 based thereon. Thus the actuator 228 may, in such cases, be said to be configured to drive movement of a second impeller portion (shown at 226) between a more-rotationally engaged position (FIG. 14) and a less-rotationally engaged position (FIGS. 15 and 15*a*) based on a fluid property. However, in some embodiments, the controller 211 may instead control the operation of the actuator 228 based on other factors which are not fluid properties. For example, the controller 211 may control the operation of the actuator based on user input from a control element inside the vehicle cockpit.

The controller 211 includes a processor 211*a* and a memory 211*b*, in which code may be stored and executed as needed for controlling the operation of the actuator 228.

The pump 210 includes a pump housing 212, a power input device 214 and an impeller assembly 216. The power input device 214 may be a pulley 218 that is connected to an input shaft 220 that is rotatably supported in the pump housing 212 by means of one or more bearings 222. The first and second impeller portions 224 and 226 may be similar to the first and second impeller portions 124 and 126 (FIGS. 6-10). However, the second impeller portion 226 may have an armature 280 connected thereto. The armature 280 is a magnetically responsive member that can be positionally controlled by an electromagnetic coil shown at 282 that is fixedly mounted to the pump housing 212. The electromagnetic coil 282 may also be referred to (for convenience) as an EM coil 282. When the EM coil 282 is not energized, the armature 280 is not drawn into engagement with the stationary EM coil 282. As a result, a biasing member 284 (e.g. a six-leaf spring) drives the second impeller portion 226 into engagement with the first impeller portion 224 (by frictional engagement between first and second drive surfaces 236 and 238). Thus, the second impeller portion 226 may be said to be in the more fully engaged position and has a first amount of engagement with the first impeller portion 224.

When the EM coil 282 is energized the armature 280 is drawn into engagement with the housing of the EM coil (referred as the EM coil housing 288), thereby drawing the second impeller portion 226 out of engagement with the first impeller portion 224. As a result, the second impeller portion 226 is no longer driven by the first impeller portion 224 and the flow rate through the pump 210 and the pressure differential across the pump 210 both decrease.

The EM coil 282 and its housing 288, the armature 280 and the biasing member 284 may together be included in the actuator 228, which is operatively connected to the second impeller portion 226.

The controller 211 may energize or deenergize the EM coil 282 based on any suitable one or more factors. In the event that at least one factor corresponds to a fluid property, the actuator 228 may be said to be configured to drive movement of the second impeller portion 226 between the more-rotationally engaged position (FIG. 14) and the less-rotationally engaged position (FIGS. 15 and 15*a*) based on a fluid property.

A shaft seal 232 is provided to prevent leakage of fluid between the input shaft 220 and the housing 212.

While the armature 280 is shown as a metallic (e.g. steel) disk that is bolted to the second impeller portion 226, it will be understood that the armature 280 may be any suitable magnetically responsive member. For example, the armature 280 could simply include a plurality of steel fasteners that are mounted to the second impeller portion 226, and which may project therefrom in the direction of the EM coil 282.

While the above description constitutes a plurality of embodiments of the present invention, it will be appreciated that the present invention is susceptible to further modification and change without departing from the fair meaning of the accompanying claims.

The invention claimed is:

1. A pump impeller assembly, comprising:

a first impeller portion that is arranged to drive a fluid through a fluid conduit;

a second impeller portion that is movable between a more-rotationally engaged position in which the second impeller portion has a first amount of rotational engagement with the first impeller portion, and a less-rotationally engaged position in which the second impeller portion has a second amount of rotational engagement with the first impeller portion that is less than the first amount of rotational engagement; and an actuator that is operatively connected to the second impeller portion and is configured to drive movement of the second impeller portion between the more-rotationally engaged position and the less-rotationally engaged position based on a fluid property, wherein the actuator is passive and is engaged with the fluid, and changes shape based on temperature of the fluid so as to be stable in a first position when the temperature of the fluid is at a temperature above a selected threshold temperature and is at a temperature below the selected threshold temperature, wherein the actuator is a bistable snap member that is movable between the first position and the second position, wherein the bistable snap member is axially connected to the second impeller portion and is not rotationally connected to at least one of the first and second impeller portions.

2. A pump, comprising:

a pump housing;

an input shaft rotatably supported by the pump housing; and an impeller assembly supported on the input shaft, wherein the impeller assembly includes a first impeller portion that is rotationally connected to the input shaft so as to be driven thereby so as to drive a fluid through a fluid conduit;

a second impeller portion that is movable between a more-rotationally engaged position in which the second impeller portion has a first amount of rotational engagement with the first impeller portion, and a less-rotationally engaged position in which the second impeller portion has a second amount of rotational engagement with the first impeller portion that is less than the first amount of rotational engagement; and an actuator that is operatively connected to the second impeller portion and is configured to drive movement of the second impeller portion between the more-rotationally engaged position and the less-rotationally engaged position based on a fluid property, wherein the actuator is passive and is engaged with the fluid, and changes shape based on temperature of the fluid so as to be stable in a first position when the temperature of the fluid is at a temperature above a selected threshold temperature and is at a temperature below the selected threshold temperature, wherein the actuator is a bistable snap member that is movable between the first position and the second position, wherein the bistable snap member is axially connected to the second impeller portion and is not rotationally connected to at least one of the first and second impeller portions.

3. A pump as claimed in claim 2, further comprising a power input device that is operatively connected to the input shaft.

* * * * *